US008081730B2

(12) United States Patent
Yuan et al.

(10) Patent No.: US 8,081,730 B2
(45) Date of Patent: Dec. 20, 2011

(54) MONITORING DEVICE FOR CONNECTORS

(75) Inventors: Guang-Dong Yuan, Shenzhen (CN); Xian-Ming Wang, Shenzhen (CN); Chung-Chi Huang, Taipei Hsien (TW); Rong Hu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 1180 days.

(21) Appl. No.: 11/828,358

(22) Filed: Jul. 26, 2007

(65) Prior Publication Data

US 2008/0304613 A1 Dec. 11, 2008

(30) Foreign Application Priority Data

Jun. 7, 2007 (CN) ..... 2007 1 0200781

(51) Int. Cl.
*G07C 3/02* (2006.01)

(52) U.S. Cl. ..... 377/16; 377/15

(58) Field of Classification Search ..... 377/15, 377/16

See application file for complete search history.

(56) References Cited

U.S. PATENT DOCUMENTS 3,878,371 A * 4/1975 Burke ..... 377/38
4,180,724 A * 12/1979 Councilman et al. ..... 377/16
4,852,104 A * 7/1989 Finger ..... 714/811
7,864,042 B2 * 1/2011 Au ..... 340/539.11

FOREIGN PATENT DOCUMENTS

DE 2922798 A1 12/1980
JP 2006-79437 A 3/2006

* cited by examiner

*Primary Examiner* — Lincoln Donovan
*Assistant Examiner* — William Hernandez
(74) *Attorney, Agent, or Firm* — Altis Law Group, Inc.

(57) ABSTRACT

An exemplary monitoring device includes: a time chip connected to a connector to generate a time signal and a count signal when the connector is working, the time signal indicating how long the connector is in use, the count signal indicating that the total number of times the connector has been used should be incremented by one; a processor connected to the time chip to receive the time signal and count signal, and generate a data signal including a total service time and a total number of times the connector has been used; a clock generator connected to the processor to provide a clock signal; and an output port connected to the processor to output the data signal. The monitoring device keeps a watch on a connector for showing the service information about the connector to make an operator know if the connector needs to be replaced.

5 Claims, 1 Drawing Sheet

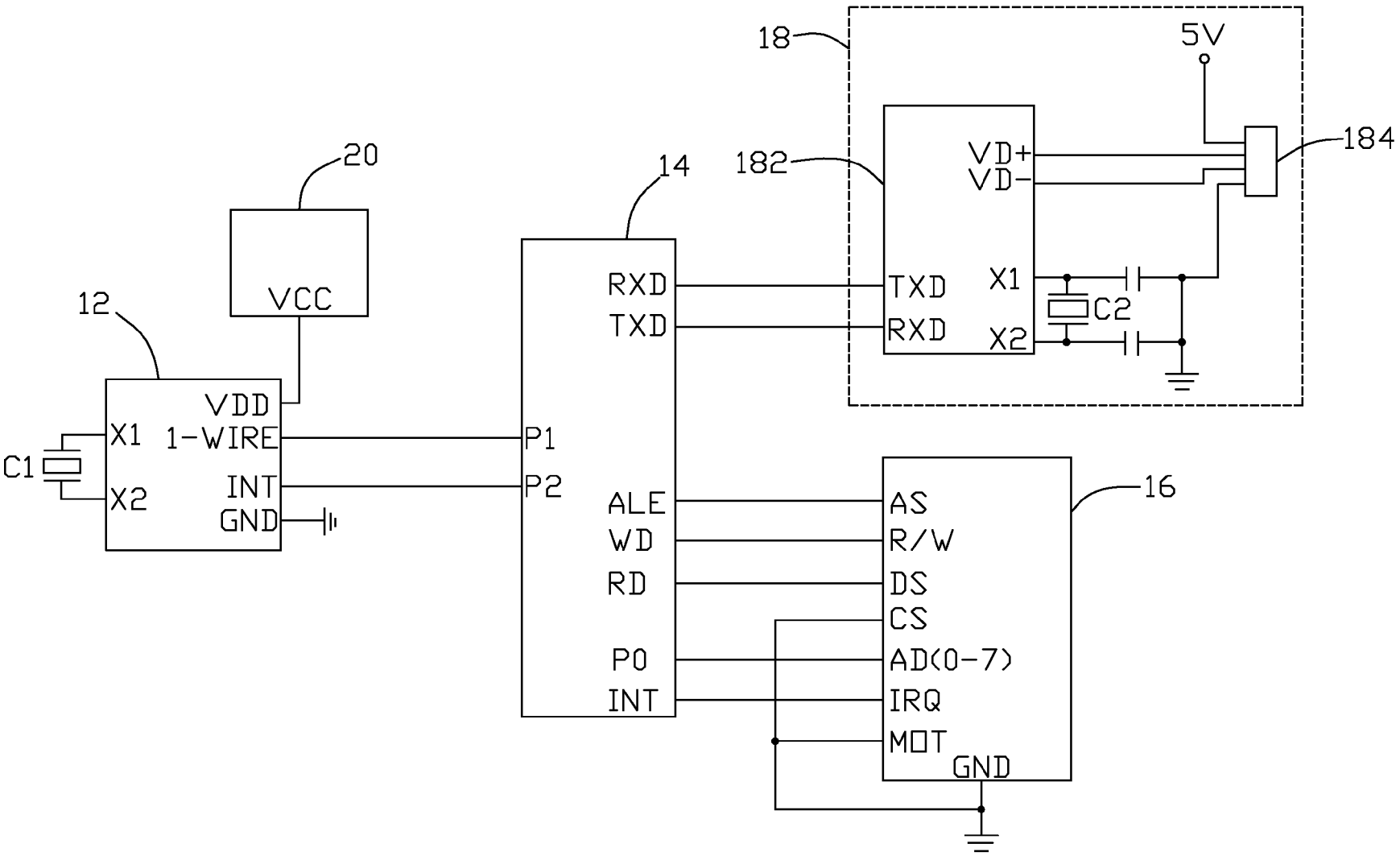
184
5V
VD+
VD-
X1
X2
C2
TXD
RXD
18
182
16
AS
R/W
DS
CS
AD(0-7)
IRQ
MOT
GND
14
RXD
TXD
ALE
WD
RD
PO
INT
P1
P2
20
VCC
VDD
1-WIRE
INT
GND
12
X1
X2
C1

MONITORING DEVICE FOR CONNECTORS

BACKGROUND

1. Field of the Invention

The present invention relates to monitoring devices, and particularly to a monitoring device for monitoring conditions of connectors.

2. Description of Related Art

A connector may suffer wear and tear if used frequently. The wear and tear of the connector will influence the signals transmitted via the connector. Therefore, an operator should replace the connector when the service lifetime of the connector ends. However, it is difficult for the operator to count using times or a service time of the connector to know when to replace the connector.

What is needed, therefore, is a monitoring device which can solve the above problem.

SUMMARY

An exemplary monitoring device includes: at least one time chip connected to a connector to generate a time signal and a count signal when the connector is working, the time signal indicating how long the connector is in use, the count signal indicating that the total number of times the connector has been used should be incremented by one; a processor connected to the at least one time chip to receive the time signal and count signal, and generate a data signal including a total service time and a total number of times the connector has been used; a clock generator connected to the processor to provide a clock signal; and an output port connected to the processor to output the data signal.

Other advantages and novel features will become more apparent from the following detailed description when taken in conjunction with the accompanying drawing, in which:

BRIEF DESCRIPTION OF THE DRAWINGS

The drawing is a circuit diagram of one embodiment of a monitoring device in accordance with the present invention.

DETAILED DESCRIPTION

Referring to the drawing, a monitoring device in accordance with an embodiment of the present invention includes a time chip 12 connected to a connector 20 to generate a time signal and a count signal when the connector 20 is in use, a processor 14 receiving the time signal and count signal, and generating a data signal including a total service time and a total of using times, a clock generator 16 connected to the processor 14 to provide a clock signal, and an output port 18 connected to the processor 14 to output the data signal to a peripheral device. The time signal indicates how long the connector is in use, and the count signal indicates that the total number of time the connector has been used should be incremented by one.

The time chip 12 is a 1-wire time chip having a power terminal VDD, a data terminal 1-WIRE, an interrupt terminal INT, a ground pin GND, and two clock terminals X1 and X2. The power terminal VDD of the time chip 12 is connected to a power terminal VCC of the connector 20. The ground pin GND is grounded. A crystal resonator C1 is connected between the clock terminals X1 and X2 of the time chip 12 to provide a clock signal to the time chip 12. The data terminal 1-WIRE and the interrupt terminal INT are connected to the processor 14 to transmit the count signal and the time signal respectively.

The processor 14 includes two data terminals P1~P2, a sending terminal TXD, a receiving terminal RXD, and five clock terminals ALE, WD, RD, P0, and INT. The data terminals P1~P2 of the processor 14 are connected to the data terminal 1-WIRE and the interrupt terminal INT of the time chip 12 respectively to receive the count signal and the time signal. The sending terminal TXD and the receiving RXD terminal are connected to the output port 18 to send the data signal, and the clock terminals ALE, WD, RD, P0, and INT are connected to the clock generator 16 to receive a clock signal.

The clock generator 16 includes a selection terminal CS, a mode terminal MOT, and a ground terminal GND all of which are grounded, and five clock terminals AS, R/W, DS, AD(0-7), and IRQ respectively connected to the clock terminals ALE, WD, RD, P0, and INT of the processor 14. The clock generator 16 provides a clock signal to the processor 14.

The output port 18 includes a USB interface chip 182 and a USB interface 184. The USB interface chip 182 includes a sending terminal TXD connected to the receiving terminal RXD of the processor 14, a receiving terminal RXD connected to the sending terminal TXD of the processor 14, two clock terminals X1~X2 connected to each other via a crystal resonator C2, and two data terminals VD+ and VD− connected to corresponding terminals of the USB interface 184.

When the connector 20 is in use, the time chip 12 is turned on to generate the count signal via the data terminal 1-WIRE and the time signal via the interrupt terminal INT. That is, when the time chip 12 is turned on, the data terminal 1-WIRE transmits a count signal to make the processor 14 know the connector 20 is in use and add one to a count number, the processor 14 accumulates the signals to give a total of how many times the connector 20 has been used. The interrupt terminal INT of the time chip 12 transmits an interrupt signal in every cycle of the time chip 12, and the processor 14 accumulates the interrupt signals to give a total of time in use of the connector 20, which is equal to the number of the interrupt signals multiplied by a cycle time of the time chip 12. The processor 14 transmits the total service time and using times to the output port 18. The output port 18 is connected to the peripheral device such as a visual display to show the data to alert an operator if the connector 20 needs to be replaced.

The number of the time chip 12 is not limited to one, it also can be two, or more that monitor a corresponding number of connectors.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A monitoring device comprising:

at least one time chip connected to a connector to generate a time signal and a count signal when the connector is working, the time signal indicating how long the connector is in use, the count signal indicating that a total number of times the connector has been used should be incremented by one;

a processor connected to the at least one time chip to receive the time signal and count signal, and generate a data signal including a total service time and the total number of times the connector has been used;

a clock generator connected to the processor to provide a clock signal; and an output port connected to the processor to output the data signal.

2. The monitoring device as claimed in claim 1, wherein the at least one time chip is a 1-wire time chip having a power terminal, a data terminal, and an interrupt terminal, the power terminal is connected to a power terminal of the connector, and the data terminal and the interrupt terminal are connected to the processor to transmit the count signal and the time signal respectively.

3. The monitoring device as claimed in claim 2, wherein the processor comprises two data terminals, a sending terminal, a receiving terminal, and a plurality of clock terminals, and wherein the data terminals of the processor are connected to the data terminal and the interrupt terminal of the time chip respectively to receive the count signal and the time signal, the sending terminal and the receiving terminal are connected to the output port to send the data signal, and the clock terminals are connected to the clock generator to receive the clock signal.

4. The monitoring device as claimed in claim 3, wherein the output port comprises a USB interface chip and a USB interface, the USB interface chip includes a sending terminal connected to the receiving terminal of the processor, a receiving terminal connected to the sending terminal of the processor, and two data terminals each connected to a corresponding terminal of the USB interface.

5. The monitoring device as claimed in claim 2, wherein a crystal resonator is connected between two clock terminals of the at least one time chip to provide a clock signal to the at least one time chip, when the connector is working, the interrupt terminal of the at least one time chip transmits an interrupt signal in every cycle of the at least one time chip to the processor which accumulates the interrupt signals to get the total service time that is equal to the number of the interrupt signals multiplied by a cycle time of the at least one time chip.

* * * * *